United States Patent [19]

Stephens

[11] Patent Number: 4,536,168

[45] Date of Patent: Aug. 20, 1985

[54] TOY VEHICLE PLAYSET

[75] Inventor: William F. Stephens, Hicksville, N.Y.

[73] Assignee: Mattel, Inc., Hawthorne, Calif.

[21] Appl. No.: 595,783

[22] Filed: Apr. 2, 1984

Related U.S. Application Data

[63] Continuation-in-part of Ser. No. 384,869, Jun. 4, 1982, abandoned.

[51] Int. Cl.[3] ..... A63H 17/40

[52] U.S. Cl. ..... 446/444; 446/441; 446/462

[58] Field of Search ..... 446/435, 441, 444, 447, 446/457, 462, 463; 273/86 B; 104/53, 54

[56] References Cited

U.S. PATENT DOCUMENTS

| | | | |
|---|---|---|---|
| 3,546,809 | 12/1970 | Nielsen | 446/441 |
| 3,814,021 | 6/1974 | McHenry | 446/444 |
| 3,984,939 | 10/1976 | Wolgamot et al. | 446/441 |
| 4,147,351 | 4/1979 | Saito | 273/86 B |
| 4,346,894 | 8/1982 | Cooper et al. | 273/86 B |
| 4,383,688 | 5/1983 | Prehodka | 273/86 B |
| 4,400,908 | 8/1983 | Nomura | 446/462 |
| 4,422,263 | 12/1983 | Masubuchi | 446/462 |

*Primary Examiner*—Robert A. Hafer
*Assistant Examiner*—Daniel Nolan
*Attorney, Agent, or Firm*—Ronald M. Goldman; Melvin A. Klein

[57] ABSTRACT

A toy vehicle playset (100) includes a stunt apparatus (102) and plurality of vehicles (104), (106) and (108). Each vehicle includes front wheel (14) having outwardly extending protuberances (20) adapted to engage a ramp (130) on stunt apparatus (102) and wheelie-inducing members (158) and (160), which are mounted inside stunt apparatus 102 for causing vehicles (104), (106) and (108) to perform wheelie-type maneuvers which are caused, in part, by increasing the speed of the vehicles automatically be engaging a shift lever (68) with a protuberance (122) provided on stunt apparatus (102).

7 Claims, 10 Drawing Figures

TOY VEHICLE PLAYSET

CROSS REFERENCE TO A RELATED APPLICATION

This application is a continuation-in-part of copending application No. 06/384,869, which was filed June 4, 1982, now abandoned.

DESCRIPTION

1. Technical Field

The present invention relates to toy vehicle playsets and more particularly to new and useful improvements in a vehicle stunt apparatus and a toy vehicle.

2. Background Art

The prior art, U.S. Pat. No. 4,141,256 to Wilson, et al, discloses a two speed inertia motor for use with toy vehicles. The inertia motor employs two gear trains which may be alternately selected by a clutch that can be shifted into locking engagement with either of the two gear trains. The inertia motor also incorporates a means for providing slippage between the drive wheel and the inertia wheel in the event that the drive wheel is jammed.

Additionally, U.S. Pat. No. 4,135,328 to Yamasaki discloses an inertia motor energized by a spring return drawstring mechanism. Speed change is selectable by a manually operated shifting mechanism. The Yamasaki disclosure is particularly directed toward a unidirectional free wheeling inertia motor.

U.S. Pat. No. 4,116,084 to Masuda discloses an inertia motor having a spring loaded intermediate gear which may be forced to disengage if the gear train is jammed. A gear shift mechanism is also disclosed which requires moving the gear shaft in its axial direction.

U.S. Pat. No. 4,059,918 to Matsusairo discloses an inertia motor wherein the flywheel for storing energy may be manually disconnected so that the flywheel may idle. Further, operation of a lever enables the direction of vehicle movement to be changed while the flywheel is rotating in one direction.

U.S. Pat. No. 3,955,429 to Holden discloses an inertia motor which is disposed on either side of the flywheel. The motor disclosed in this patent is designed to have a gyroscopic action which is of importance in its application.

U.S. Pat. No. 4,183,174 discloses a self-propelled, four-wheel vehicle in which one of the rear wheels is motor driven, and the other rear wheel is arranged to be free-wheeling. Depending upon the selected drive torque transmitted to the single driven wheel, the vehicle either moves straight and level, or performs a wheel stand while moving circularly. A user can select the desired vehicle motion from a remote location.

U.S. Pat. No. 4,349,983 discloses a carrying case which may be opened to present upper and lower scene-simulating objects including a serpentine roadway for toy vehicles which may coast down the roadway from the top of the rearwall of an upper carrying case portion to the bottom wall of a lower carrying case portion hinged to the upper carrying case portion along a diagonal line.

DISCLOSURE OF INVENTION

In accordance with the present invention, a new and useful toy vehicle playset is provided. The playset includes a stunt apparatus having ramp members which may be engaged by protuberances extending from the front wheels of a toy vehicle in a manner such that the vehicle is caused to perform side wheelies and front wheelies. The stunt apparatus also includes a mechanism which may engage a shifting mechanism on the toy vehicle to cause the vehicle to increase its speed.

BRIEF DESCRIPTION OF THE DRAWINGS

Details of the present invention will be described in connection with the accompanying drawings wherein.

BEST MODE FOR CARRYING OUT THE INVENTION

This invention pertains to a toy car or vehicle which is driven by an inertia motor. The inertia motor can drive the toy car on its track at two speeds. The first speed is available after energizing the inertia motor. The second speed is provided when a projection on the toy car encounters a contact located on the track. The purpose of the speed change is to provide a second speed so that the toy car can perform acrobatics.

Figure 1:
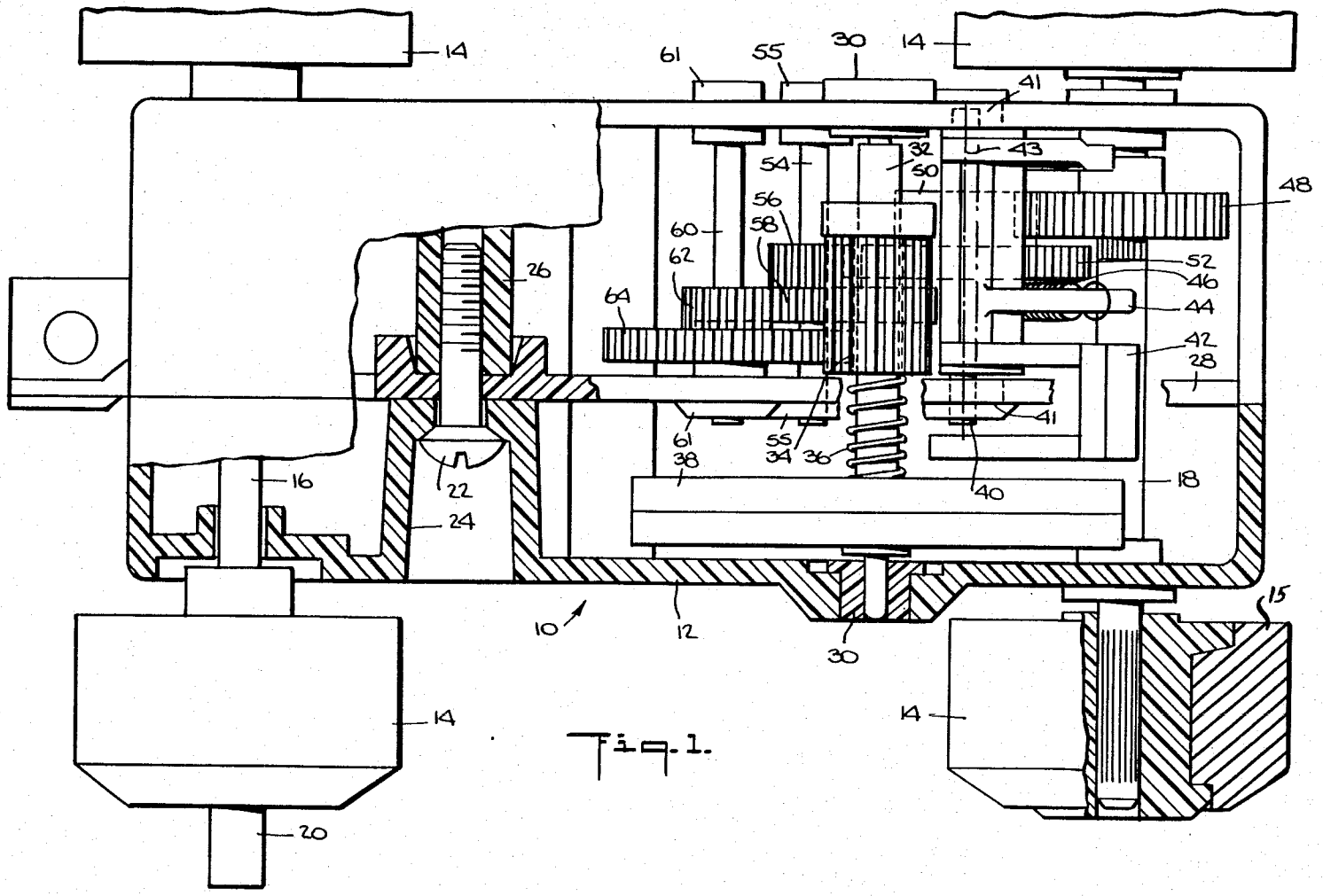
FIG. 1 is a partial section of the top plan view of a toy vehicle embodying the present invention.

FIG. 1 shows a car 10 having a body 12. The body 12 comprises a set of wheels 14. The wheels 14 are supported on a front axle 16 and a rear axle 18. An extension or protuberance 20 on front wheels 14 or front axle 16 is provided for engagement with the track. The body 12 consists of two portions held together by a self-tapping screw 22, one portion having a recessed socket 24 for holding the head of the screw 22 and the other portion having a post 26 for receiving the threaded shank of the screw 22. The front axle 16 and the rear axle 18 are seen to be supported by bearings in the outer walls of the body 12. A pair of main bearings 30 support a main shaft 32 upon which is fixed a main pinion 34. Also mounted on shaft 32 is a compression spring 36 biased between a spring retainer and a flywheel 38. Between the outer wall of body 12 and an internal wall 28 are mounted several shafts to be further described.

One of the most important is a speed change shaft 40 held captive by an elongated bearing pair 41. A speed change shaft support 42 is able to move with the speed change shaft 40. Movement of the shaft support 42 is principally about an axis of rotation 43. The shaft support 42 has extending therefrom a support lever 44. One end of a tension spring 46 is hooked to the support lever 44; the other end of the tension spring 46 is attached to the speed change shaft 40. The rear axle 18 has affixed to it a rear axle gear 48 which is in continual contact with a first speed change gear 50 affixed to the speed change shaft 40. A second speed change gear 52, integral with gear 50, is also mounted on the speed change shaft 40.

A first intermediate shaft 54 is supported by a first bearing pair 55 between the outer wall of body 12 and the internal wall 28. Affixed to the first intermediate shaft 54 are a first pinion 56 and a first gear 58. A second intermediate shaft 60 is similarly supported by a second bearing pair 61 between the outer wall of body 12 and the internal wall 28. Affixed to the second intermediate shaft 60 are a second pinion 62 and a second gear 64. The speed change shaft support 42 has a notch 66 formed in its mid-portion. The lower portion of support 42 has an extension 68 protruding therefrom.

Figure 2:
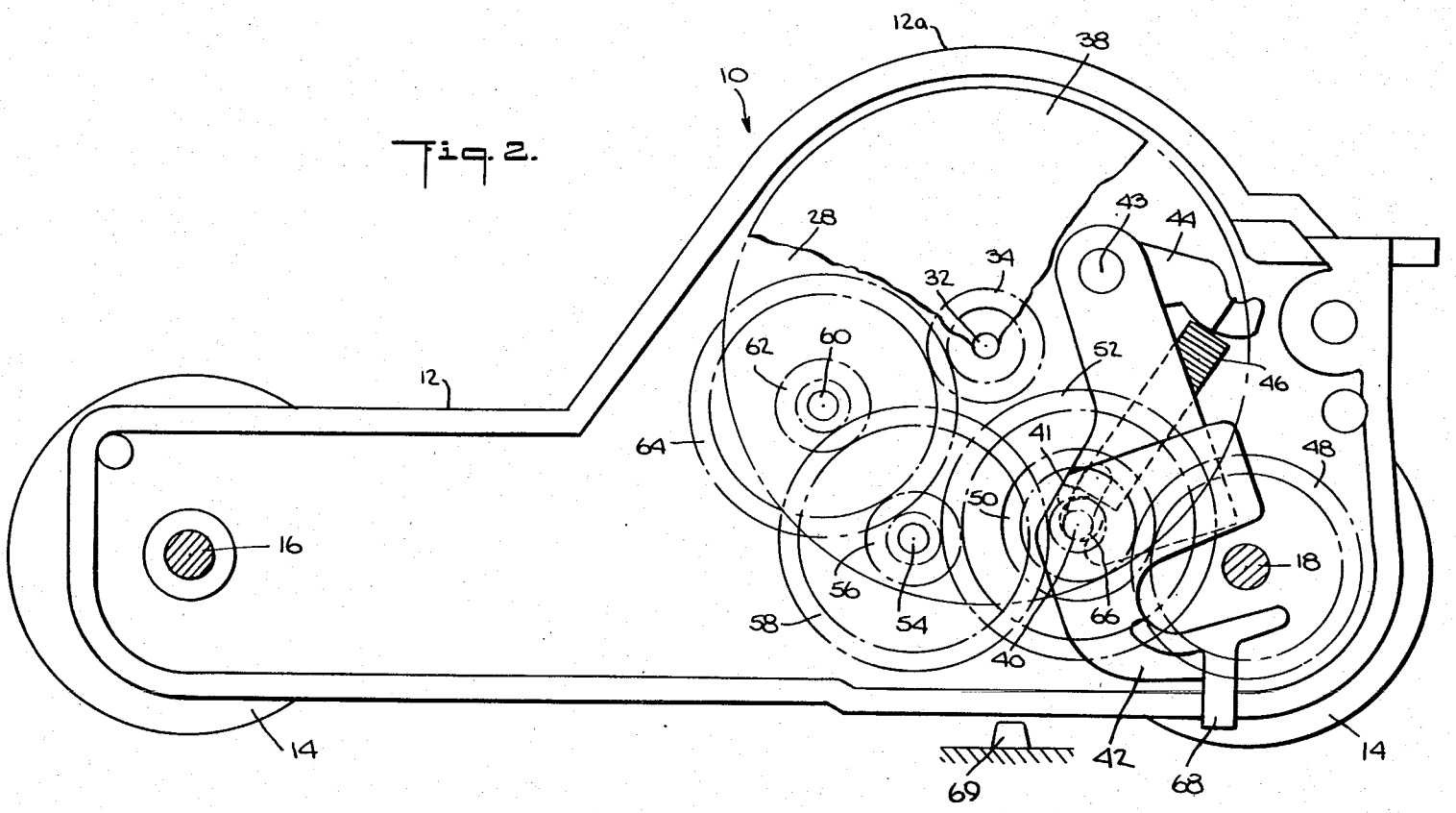
FIG. 2 is a side view of the toy vehicle with "normal" gearing.

FIG. 2 is a side view of the car 10 showing the relationship among the various gears, pinions and shafts. Specifically, FIG. 2 shows that body 12 has an enlargement 12*a* which houses the inertia motor and shows the speed change shaft 40 in its "normal" position.

The wheels 14 can be seen mounted on the front axle 16 and the rear axle 18. A partial cutaway of the internal wall 28 shows the flywheel 38. Seen in interrupted line form is the rear axle gear 48, shown engaging first speed change gear 50 which is affixed to the speed change shaft 40. The speed change shaft 40 is shown to be disposed at the bottom of elongated bearing pair 41, being held there by the notch 66. In the aforesaid position the second speed change gear 52 engages the first pinion 56 which is affixed to the first intermediate shaft 54. The first gear 58 is also affixed to shaft 54 and engages the second pinion 62 affixed to the second intermediate shaft 60. The shaft 60 also has affixed to itself the second gear 64 which engages the main pinion 34. The main pinion 34 operates the flywheel 38.

Figure 3:
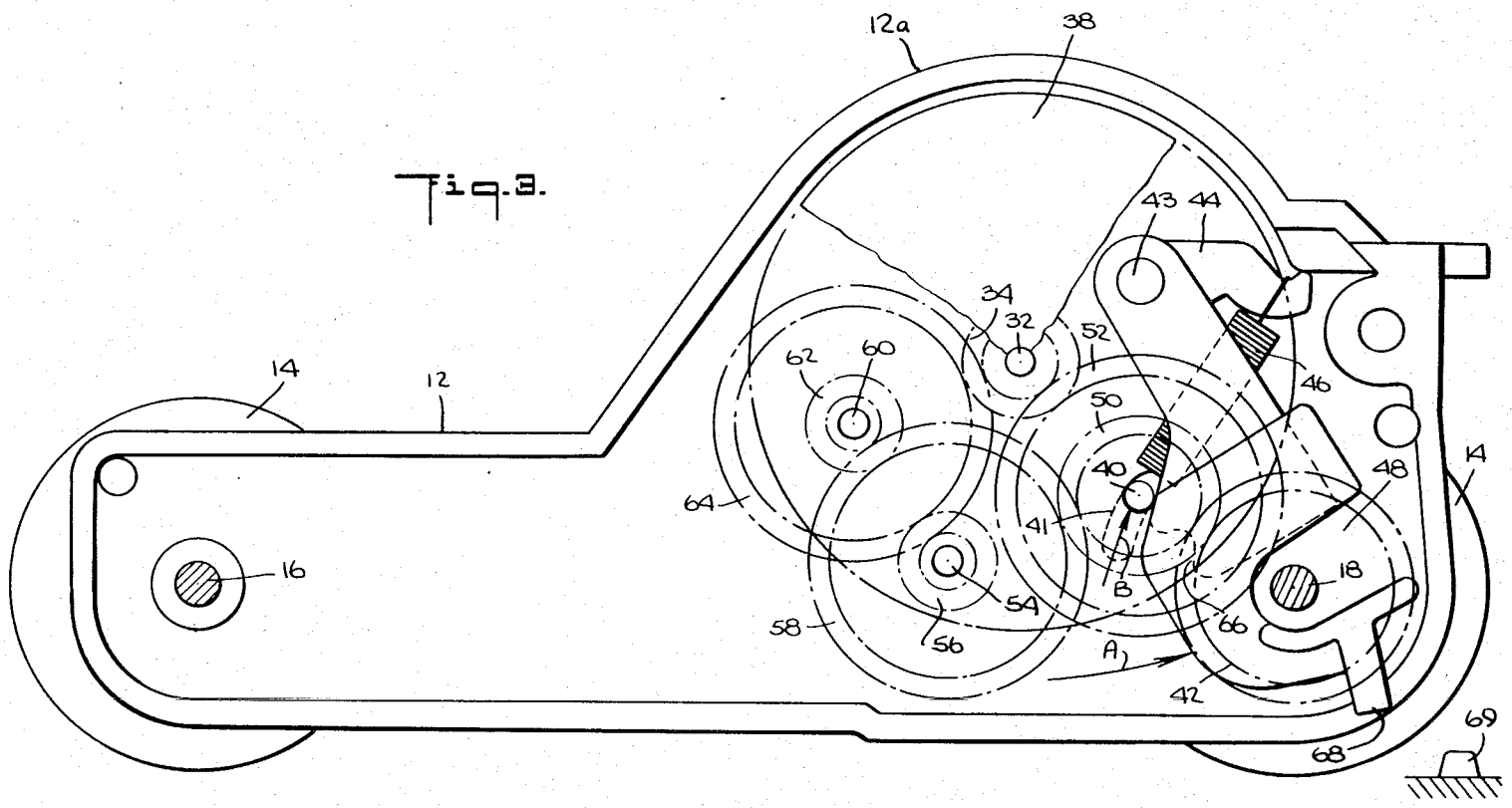
FIG. 3 is a second side view of the toy vehicle after the speed change.

FIG. 3 illustrates the same elements as FIG. 2 except for the following difference. In FIG. 2 the extension 68 is shown protruding from the body 12 whereas in FIG. 3 the extension 68 is shown withdrawn within the body 12. In the withdrawn position of FIG. 3 the speed change shaft support 42 has moved toward the right of FIG. 3, as shown by an arrow A. As the support 42 moves in the direction of the arrow A the speed change shaft 40 is released from notch 66. The spring 46 urges the speed change shaft 40 in the direction of an arrow B. Shaft 40 then lodges against the upper end of the elongated bearing pair 41. The first speed change gear 50 always remains engaged with the rear axle gear 48 although the second speed change gear 52 now engages the main pinion 34.

Operation of the toy vehicle of FIGS. 1–3 is believed to be apparent and will be briefly summarized at this point. The car 10 has its inertia motor energized by moving the body 12 while the wheels 14 are in contact with some stationary surface. The aforementioned procedure may be used to cause the flywheel 38 to rotate at a high speed in order to store a large quantity of kinetic energy. When the body 12 is released and the wheels 14 are in contact with some stationary surface such as a track the car 10 will be propelled along the surface. The spring 36 causes the flywheel 38 to be frictionally coupled to the main shaft 32. Should an obstruction abruptly stop the car and thereby stop the rotation of the main pinion 34, the frictional spring coupling between the main pinion and the flywheel 38 will prevent injury to the inertia motor.

FIG. 2 shows the gear arrangement which pertains during energizing of the flywheel 38. Although after a particular run of the car 10 the speed change shaft support 42 may be in the position shown in FIG. 3 upon energizing of the inertia motor the speed change shaft 40 will assume the position shown in FIG. 2. The gear train (FIG. 1) includes the rear axle gear 48 which engages the first speed change gear 50. Second speed change gear 52, which is integral with gear 50, engages the first pinion 56. The first pinion 56 rotates the first gear 58 which engages the second pinion 62. The second pinion 62 causes the second gear 64 to rotate and since the second gear 68 is engaged with main pinion 34 it results in the rotation of the flywheel 38.

The gear train just described is that "normally" used to power the car 10. Car 10 when used with the track for which it is designed will at some predetermined point pass over a contact or protuberance 69 located on the surface of the track. This contact will strike the extension 68 causing it to move in the direction of arrow A of FIG. 3. When the speed change shaft 40 is released from the notch 66 it moves along the elongated bearing pair 41. The second speed change gear 52 moves from engagement with the first pinion 56 to engagement with the main pinion 34. Engagement of main pinion 34 with the second speed change gear 52 which is connected to second speed change pinion 50 causes a rapid acceleration of both which in turn by the engagement of second speed change pinion 50 with the rear axle gear 48 connected through the rear axle 18 to the rear wheels 14 cause a rapid acceleration of rear wheels 14. This rapid acceleration of the car 10 is used to perform acrobatic maneuvers when required by the associated track. Assisting in this performance are rear wheel tires 15 made of rubber or equivalent material having a relatively high frictional coefficient.

Figure 4:
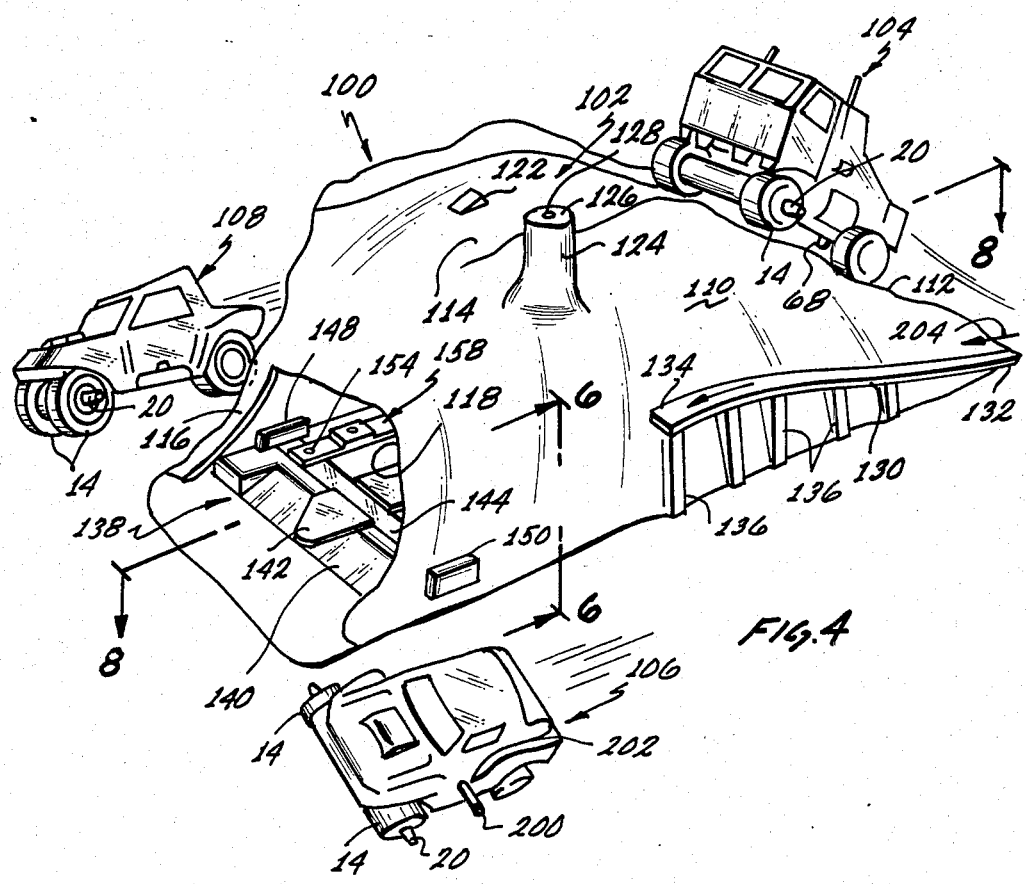
FIG. 4 is a perspective view of a stunt apparatus and vehicle of the present invention.
Figure 5:
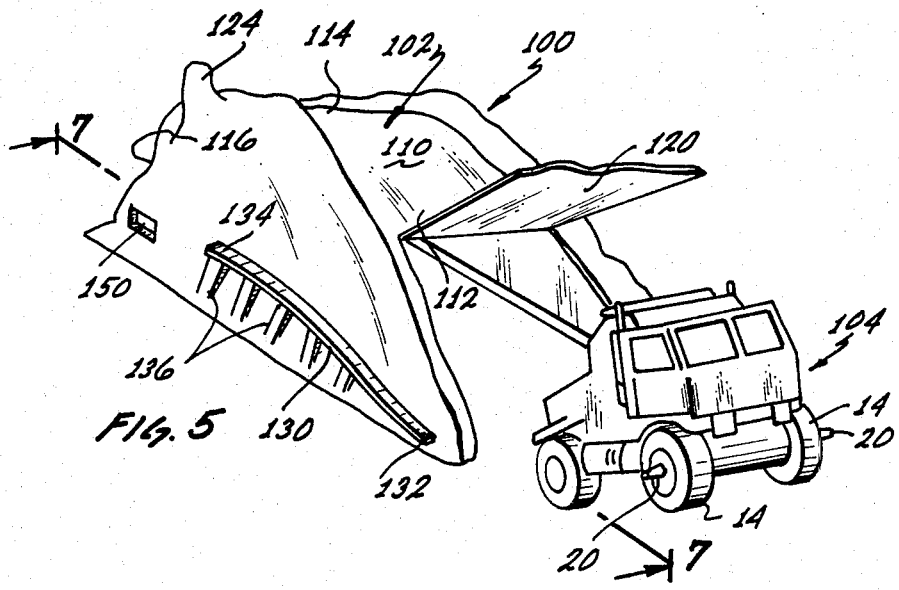
FIG. 5 is a perspective view of the stunt apparatus and vehicle of FIG. 4 showing the apparatus and vehicle in a different operating position.
Figure 7:
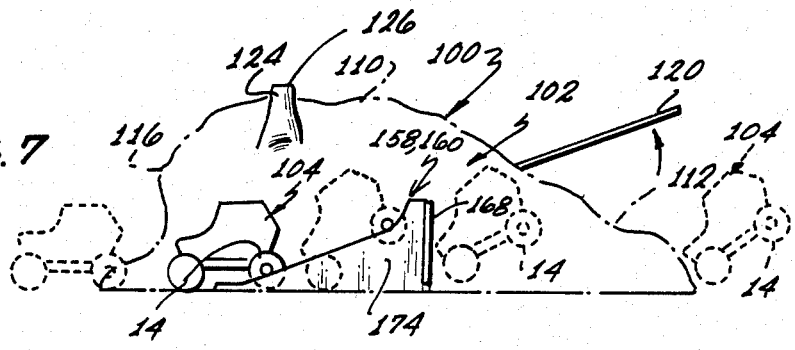
FIG. 7 is a cross-sectional view taken along line 7—7 of FIG. 5.

Referring now to FIGS. 4 and 5, a toy vehicle playset of the present invention, generally designated 100, may include a stunt apparatus 102 and one or more toy vehicles, like the vehicle 10 previously described and the ones shown at 104, 106 and 108 in FIG. 4. Stunt apparatus 102 includes a cave-simulating housing 110 which defines a hill having an upwardly-sloping first portion 112 and a substantially horizontal second portion 114 extending forwardly from the first portion 112 to the front wall portion 116 of housing 110. Front wall portion 116 is provided with an opening 118 of sufficient size to permit vehicles 104, 106, 108 to enter the front of housing 110 and leave housing 110 by causing a door 120 to swing open at the rear of housing 110, as shown in FIGS. 5 and 7.

Portions 112 and 114 of housing 110 provide a suitable path or track for vehicles 10, 104, 106, 108 which may climb the upwardly-sloping portion 112 in low gear and then be automatically shifted into high gear by a contact or protuberance 122 provided on the surface of the second portion 114, whereupon the vehicles will jump off of stunt apparatus 102 at a high rate of speed, as indicated by vehicle 108 in FIG. 4.

A simulated stump 124 is provided on housing 110 and includes an upper surface 126 which is provided with a small cavity 128, for a purpose to be hereinafter described. A ramp 130 may be provided on the side of housing 110 and includes a first end 132, lying at ground level at the rear of housing 110, and a second end 134 which is elevated somewhat above ground level. Ramp 130 may be molded integrally with housing 110 from a suitable polymeric material and may be reinforced by suitable struts 136.

Figure 8:
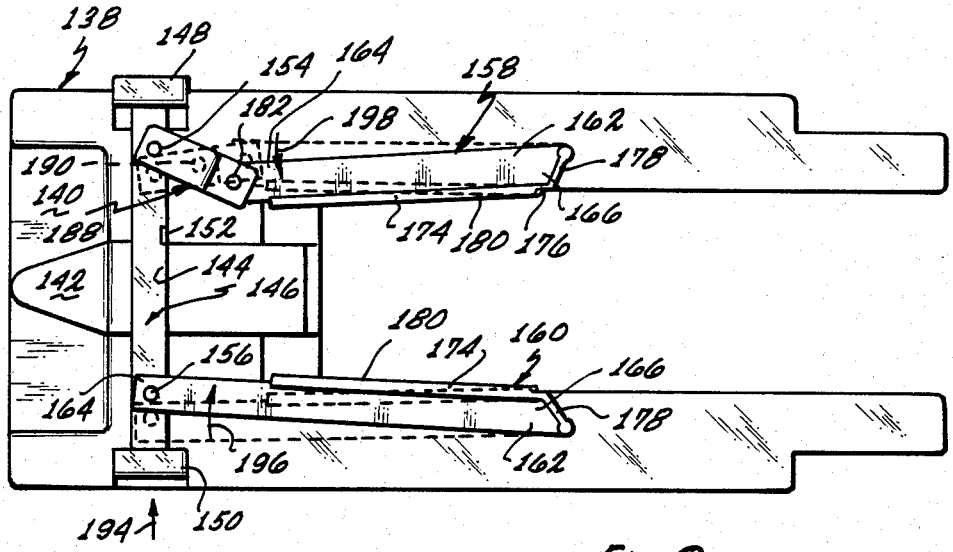
FIG. 8 is a plan view of the internal mechanism in the stunt apparatus of FIG. 4.
Figures 9, 10:
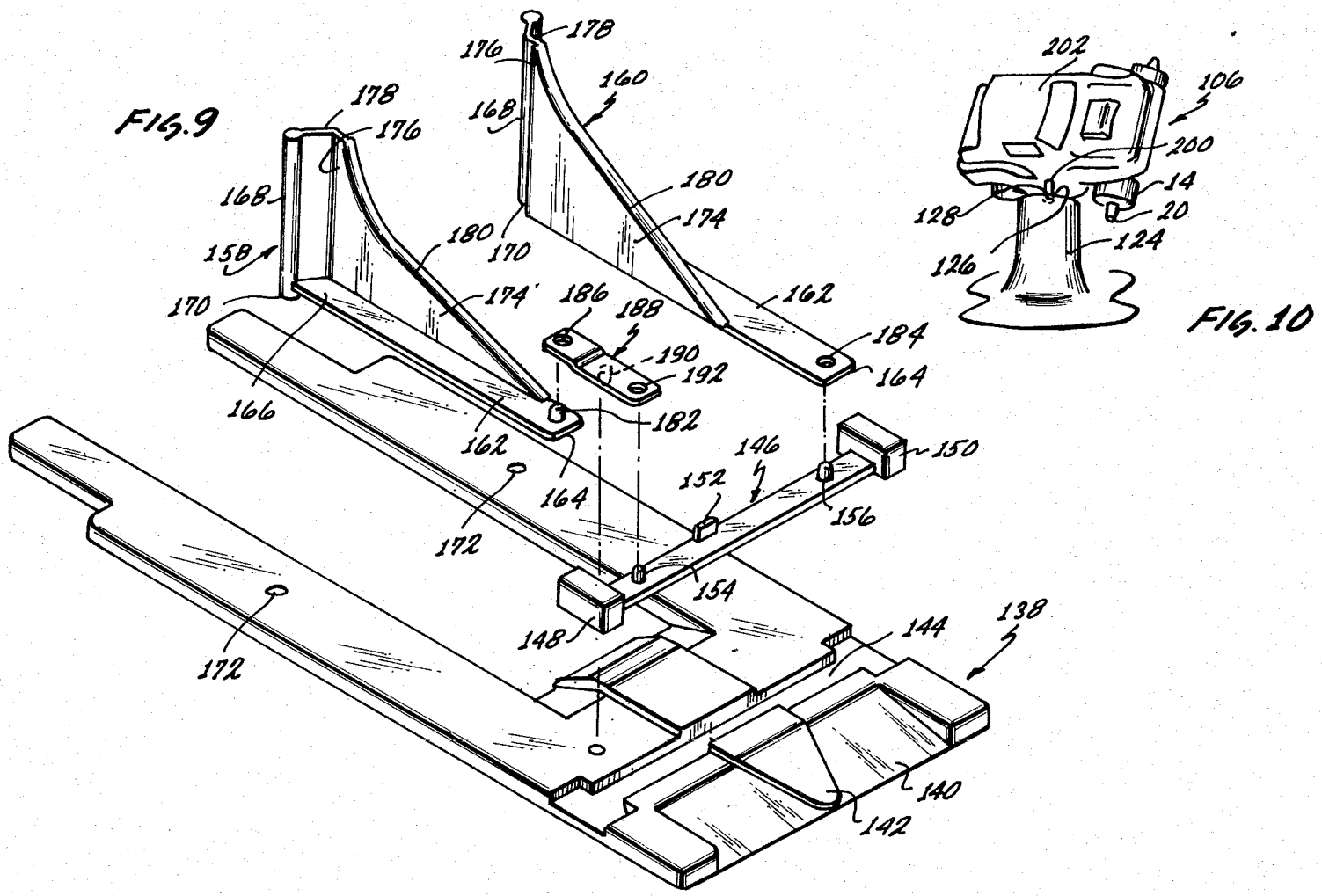
FIG. 9 is an exploded perspective view of the internal mechanism of FIG. 8.
FIG. 10 is a partial perspective view of the stunt apparatus of FIG. 4 showing a vehicle of FIG. 4 in position thereon.

Housing 110 may be mounted on a suitable base member 138 having an entrance portion 140 to which a vehicle guide 142 is affixed. Referring now to FIGS. 4, 8 and 9, base member 138 is provided with a transverse channel 144 in which an axially-shiftable rod 146 is slidably mounted for lateral movement by actuating buttons 148, 150 which are mounted on the right-hand and left-hand ends of rod 146, respectively, and which extend through suitable openings provided in housing 110 for exterior acatuation by a child-user of playset 100. Rod 146 carries an upstanding tab or protuberance 152, a first upstanding pivot pin 154, which is located adjacent actuating button 148, and a second upstanding pivot pin 156, which is located adjacent actuating button 150.

Referring now to FIGS. 7, 8 and 9, playset 100 also includes a pair of wheelie-inducing members 158, 160, each including a base member 162 having a front end 164 and a rear end 166. An upstanding post 168 is affixed to each rear end 166 and includes a depending portion 170 (FIG. 9) adapted to engage an aperture 172 provided in floor 138 adjacent each edge thereof. Each base 162 carries an upstanding, substantially triangular-shaped member 174, each having a rear end 176 connected to an associated one of the posts 168 by a reinforcing web 178. An inturned flange 180 is affixed to the upper surface of each triangular member 174, a pivot pin 182 is upstanding from the front end of wheelie-inducing member 158 and an aperture 184 is provided in the front end 164 of wheelie-inducing member 160. Aperture 184 is adapted to engage pivot pin 156 for connecting member 160 to rod 146 and pivot pin 182 is adapted to engage an aperture 186 provided in one end of a link 188 which, in turn, is connected to base member 138 by pivot pin 190 and to pivot pin 154 on rod 146 by an aperture 192. Referring now to FIG. 8, when button 150 is pushed in the direction of arrow 194, pivot pin 156 will move end 164 of wheelie-inducing member 160 inwardly in the direction of arrow 196 and link 188 will move end 164 of member 158 inwardly in the direction of arrow 198.

Referring again to FIG. 4, vehicles 104, 106 and 108 each includes the inertial motor, gear train and associated parts described in connection with vehicle 10 (FIGS. 1–3). Additionally, each vehicle includes a protuberance 20 extending outwardly from each front wheel 14.

Vehicle 106 also includes a fixed pin 200 which extends outwardly from the left-hand side of the body portion 202 of vehicle 106.

Each vehicle also carries an extension like the one shown at 68 in FIG. 4 for vehicle 104 and in FIGS. 2 and 3 for vehicle 10.

Operation of toy vehicular playset 100 is believed to be apparent from the foregoing and will be briefly summarized at this point. As best seen in FIG. 4, vehicle 104 may be set in motion in the direction of arrow 204 so that it will climb the hill defined by housing portion 112 and move onto the path defined by horizontal portion 114 whereupon extension 68 will engage protuberance 122 and shift vehicle 104 into high gear so that it will jump off of hill 110 at high speed, as indicated by the vehicle 108.

Figure 6:
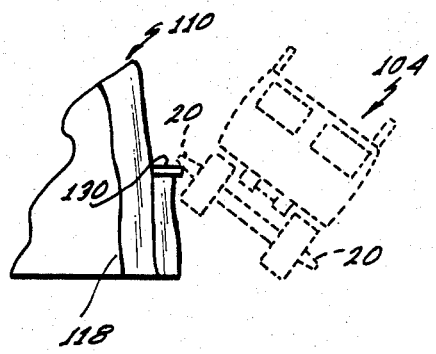
FIG. 6 is a partial cross-sectional view taken along line 6—6 of FIG. 4.

Vehicle 106 may also by set in motion in the direction of arrow 204 in a manner such that the protuberance 20 on right front wheel 14 will engage ramp 130, as shown in FIG. 6 in connection with vehicle 104, and cause vehicle 106 to do a side wheelie on its left-hand wheels.

Referring now to FIGS. 7 and 8, button 150 may be moved in the direction of arrow 194 to position wheelie-inducing members 158, 160 inwardly, as shown in full lines in FIG. 8, so that a vehicle entering the front of housing 110 will have its speed increased by engaging tab 152 whereupon the vehicle will move at high speed with the front wheel protuberances 20 each engaging an associated one of the inturned flanges 180 on wheelie-inducing members 158, 160 so that the front of the vehicle will be elevated, as indicated in FIG. 7, and push door 120 open permitting the vehicle to move out of housing 110 while performing a rear wheelie.

Referring now to FIG. 10, pin 200 may be used to balance vehicle 106 on stump 124 with the inertial motor in vehicle 106 energized and vehicle 106 will remain in this position as long as the motor keeps running.

While the particular toy vehicle playset herein shown and described in detail is fully capable of attaining the objects and providing the advantages hereinbefore stated, it is to be understood that it is merely illustrative of the presently-preferred embodiment of the invention and that no limitations are intended to the details of construction or design herein shown other than as defined in the appended claims.

What is claimed is:

1. In combination with a vehicle stunt apparatus and a toy vehicle having at least one front wheel, at least one rear wheel, a motor for powering said vehicle, said motor includinq a flywheel, a gear train connecting said motor to one of said wheels, said gear train including a first set of gears for operating said vehicle in a low speed mode and a second set of gears for operating said vehicle in a high speed mode, a shifting lever connected to said gear train for shifting said gear train from one of said modes to the other of said modes, said shifting lever extending from said vehicle, and a first protuberance mounted in the path said vehicle is adapted to travel for engaging said shifting lever to shift said gear train, the improvement which comprises:

means connecting said shifting lever and said gear train in a manner such that said gear train is shifted into said high speed mode when said first protuberance engages said shifting lever;

a hill defined by said stunt apparatus, said hill including a first portion sloping upwardly from ground level to an elevated position and a second portion extending approximately horizontally forwardly from the elevated position of said first portion, said first protuberance being provided on said second portion of said hill, whereby said vehicle may be caused to climb said first portion of said hill in a lower gear, automatically shift into a higher gear on said second portion of said hill and jump off said second portion at a high rate of speed; and wherein said vehicle includes two front wheels and two rear wheels, wherein said vehicle stunt apparatus includes a first ramp member having a first end at ground level and a second end elevated above ground level and wherein said toy vehicle includes a second protuberance extending outwardly from one of said front wheels for riding up said first ramp member, whereby said vehicle will be force over into a slide wheelie so that said vehicle will travel on one front wheel and one rear wheel.

2. In combination with a vehicle stunt apparatus and a toy vehicle having a pair of front wheels, a pair of rear wheels and a motor for powering said vehicle, the improvement which comprises:

a first ramp member affixed to said stunt apparatus and having a first end at ground level and a second end elevated above ground level; and a first protuberance extending outwardly from one of said front wheels for riding up said first ramp member, whereby said vehicle will be forced over into a side wheelie so that said vehicle will travel on one front wheel and one rear wheel.

3. A combination as recited in claim 2 wherein said toy vehicle includes a second protuberance extending outwardly from the other of said front wheels and wherein said vehicle stunt apparatus includes second and third ramp members corresponding in size and shape with each other, said second and third ramp members extending parallel to and being spaced from each other in a manner such that said front wheels and said rear wheels may pass between said second and third ramp members with said first and second protuberances riding on said second and third ramp members, respectively, whereby said vehicle will be forced up into a rear wheelie so that said vehicle will travel on said rear wheels with said front wheels elevated.

4. A combination as recited in claims 2 or 3 wherein said motor includes a flywheel.

5. In combination with a vehicle stunt apparatus and a toy vehicle having a pair of front wheels, a pair of rear wheels and an inertia motor for powering said vehicle, the improvement which comprises:

a post affixed to said vehicle stunt apparatus;

a pin affixed to one side of said toy vehicle for balancing said vehicle on said post;

a first ramp member affixed to said stunt apparatus and having a first end at ground level and a second end elevated above ground level; and a first protuberance extending outwardly from one of said front wheels for riding up said first ramp member, whereby said vehicle will be forced over into a side wheelie so that said vehicle will travel on one front wheel and one rear wheel.

6. A combination as recited in claim 5 wherein said toy vehicle includes a second protuberance extending outwardly from the other of said front wheels and wherein said vehicle stunt apparatus includes second and third ramp members corresponding in size and shape with each other, said second and third ramp members extending parallel to and being spaced from each other in a manner such that said front wheels and said rear wheels may pass between said second and third ramp members with said first and second protuberances riding on said second and third ramp members, respectively, whereby said vehicle will be forced up into a rear wheelie so that said vehicle will travel on said rear wheels with said front wheels elevated.

7. In combination with a vehicle stunt apparatus and a toy vehicle having two front wheels, two rear wheels, a motor for powering said vehicle, said motor including a flywheel, a gear train connecting said motor to at least one of said wheels, said gear train including a first set of gears for operating said vehicle in a low speed mode and a second set of gears for operating said vehicle in a high speed mode, a shifting lever connected to said gear train for shifting said gear train from one of said modes to the other of said modes, said shifting lever extending from said vehicle, and a first protuberance mounted in the path said vehicle is adapted to travel for engaging said shifting lever to shift said gear train, the improvement which comprises:

means connecting said shifting lever and said gear train in a manner such that said gear train is shifted into said high speed mode when said first protuberance engages said shifting lever;

a hill defined by said stunt apparatus, said hill including a first portion sloping upwardly from ground level to an elevated position and a second portion extending approximately horizontally forwardly from the elevated position of said first portion, said first protuberance being provided on said second hill, whereby said vehicle may be caused to climb said first portion of said hill in a lower gear, automatically shift into a higher gear on said second portion of said hill and jump off said second portion at a high rate of speed;

a first member having a first end at ground level and a second and elevated above ground level included on said vehicle stunt aparatus;

a second protuberance formed on said toy vehicle extending outwardly from one of said front wheels for riding up said first ramp member, whereby if said second protuberance contacts said first member, said vehicle will be forced over into a side wheelie so that said vehicle will travel on one front wheel and one rear wheel;

a third protuberance formed on said toy vehicle extending outwardly from the other of said front wheels; and second and third ramp members included in said vehicle stunt apparatus, said second and third ramp members corresponding in size and shape to each other, and extending parallel to and being spaced from each other in such a manner that said front wheels and said rear wheels may pass between said second and third ramp members with said second and third protuberances riding on said second and third ramp members, respectively, whereby said vehicle will be forced up into a rear wheelie so that said vehicle will travel on said rear wheels with said front wheels elevated.

* * * * *

UNITED STATES PATENT AND TRADEMARK OFFICE

CERTIFICATE OF CORRECTION

PATENT NO. : 4,536,168

DATED : August 20, 1985

INVENTOR(S) : William F. Stephens

It is certified that error appears in the above—identified patent and that said Letters Patent is hereby corrected as shown below:

Claim 1, Col. 6, line 33, change the spelling of "includinq" to --including--.

Claim 1, Col. 6, line 66, change the spelling of "force" to --forced--.

Claim 1, Col. 6, line 67, change the spelling of "slide" to --side-- .

Signed and Sealed this

Fourth Day of February 1986

[SEAL]

*Attest:*

DONALD J. QUIGG

*Attesting Officer*

*Commissioner of Patents and Trademarks*